US005395003A

United States Patent [19]

Matsuda

[11] Patent Number: 5,395,003

[45] Date of Patent: Mar. 7, 1995

[54] COVERED AIRTIGHT CONTAINER

[75] Inventor: Yoshitaka Matsuda, Shinminato, Japan

[73] Assignee: Kabushiki Kaisha Maruwa Seisakusho, Shinminato, Japan

[21] Appl. No.: 177,268

[22] Filed: Jan. 4, 1994

[51] Int. Cl.[6] ..... B65D 17/34

[52] U.S. Cl. ..... 220/270; 220/276; 220/306; 220/308; 215/256; 215/317; 215/344

[58] Field of Search ..... 220/270, 276, 306, 308; 215/254, 256, 317, 344

[56] References Cited

U.S. PATENT DOCUMENTS

| | | | |
|---|---|---|---|
| 3,338,446 | 8/1967 | Faulstich | 215/254 |
| 3,441,161 | 4/1969 | Van Baarn | 215/256 X |
| 4,417,666 | 11/1983 | Roberts | 215/256 |
| 4,676,389 | 6/1987 | Bullock | 215/232 |
| 4,860,907 | 8/1989 | Sondal | 215/230 |
| 4,903,849 | 2/1990 | Wallman | 215/256 |
| 5,036,991 | 8/1991 | Wallman | 215/256 |
| 5,197,619 | 3/1993 | Margaria | 215/256 |
| 5,238,135 | 8/1993 | Landis | 220/276 |

*Primary Examiner*—Allan N. Shoap
*Assistant Examiner*—Stephen Cronin
*Attorney, Agent, or Firm*—Flynn, Thiel, Boutell & Tanis

[57] ABSTRACT

A covered airtight container capable of preventing a soup from leaking therefrom. The covered airtight container comprises a body made of hard plastics and a cover made of soft plastics wherein the cover has a reverse channel-shaped edge portion piece formed by bending the upper end edge thereof upward and reversing it downward so as to cover the upper end portion of the body. The body has an annular stepped portion to which the cover is retained at the inner peripheral surface of the upper end portion of the peripheral wall. The cover has an annularly projected fin for elastically contacting the edge of said annular stepped portion. The covered airtight container may be formed square shaped with circumferential surfaces of the body and cover being slightly curved shape close to a circle. Particularly, the leaking prevention effect can be conspicuous since the sealing effect or state is assured at the inner and outer surfaces of the peripheral wall of the body. Even if the edge portion piece is pulled off after the cover is open so that the vertical double annular projection of the body is disengaged from the vertical annular grooves, the soup is prevented from leaking because of the annular fin of the cover. As a result, the container can be used even after the cover is open. When the covered airtight container is formed square shaped while the circumferential surfaces of the body and cover are formed in a curved shape, it does not occupy much space during transportation or the keeping thereof and the end of the edge portion piece of the cover can be cut off along the upper annular groove, which is very convenient for handling.

9 Claims, 2 Drawing Sheets

COVERED AIRTIGHT CONTAINER

BACKGROUND OF THE INVENTION

1. Field of the Invention

The present invention relates to a covered airtight container made of plastics for packing and selling processed foodstuffs such as fishes, shellfishes and edible wild plant, etc.

2. Prior Art

There has been widely employed a covered airtight container comprising a body made of hard material and a cover made of flexible material in which the body has a projection at an upper end outer peripheral surface of a peripheral wall and the covet- has an edge portion piece formed by bending the upper end edge thereof upward and reversing it downward for engaging with the upper end portion of the peripheral wall of the body. The cover also has and an annular groove at the inner peripheral surface of the edge portion piece for engaging in the projection of the body. In such a prior art covered airtight container, the sealing state of the cover is stable if the projection of the body is triangular in cross section to Form a clearance angle at the lower portion. However, the edge portion piece of the cover must be cut off along the annular groove since the cover can not be removed from the body as it is. As illustrated in FIG. 1, a notched window 29 is provided at a part of the edge portion piece 17. A cutoff device 4 comprises a knob 31 which is provided on the lower end portion 17A of the edge portion piece 17 and disposed at the lower end portion of the notched window 29. The knob 31 projects from one end of the lower end portion of the notched portion 29 and connects to the other end thereof at a point connection 33. If the knob 31 is pulled out and cut off at the point connection 33, the lower end portion 17A of the edge portion piece 17 can be pulled off.

An advantage of such a prior art covered airtight container, there is that soup does not leak from the container because of the airtight connection between the projection of the body and the groove of the cover and the cover does not come off until it is opened. However, the disadvantage is that there is a possibility that the soup leaks when the body is thermally expanded or shocked during its conveyance because the body and the cover are connected by a single projection and groove. Particularly, when the cover is open, namely, the body is uncovered, the soup is liable to leak because of there is no connection between the annular projection and the annular groove. This is true even if the cover is closed, namely, the body is covered by the cover.

SUMMARY OF THE INVENTION

Under the circumstances, it is an object of the invention to provide a covered airtight container capable of effectively preventing soup from leaking.

To achieve the above object, a first aspect of the invention is to provide a covered airtight container comprising a body made of hard plastics and a cover made of soft plastics wherein the cover has a reverse channel-shaped edge portion piece formed by bending the upper end edge thereof upward and reversing it downward so as to cover the upper end portion of the peripheral wall of the body. The body has vertically arranged double annular projections at the outer peripheral surface of the upper end portion of the peripheral wall, each annular projection being triangular in cross section to form a clearance angle at the lower portion. The edge portion piece of the cover has vertically arranged double annular grooves for engaging with the annular projections of the body and the cover is also provided with a cutoff means extending along the upper annular groove of the cover for opening the cover.

A second aspect of the invention is to provide a covered airtight container comprising a body made of hard plastics and a cover made of soft plastics wherein the cover has a reverse channel-shaped edge portion piece formed by bending the upper end edge thereof upward and reversing it downward so as to cover the upper end portion of the peripheral wall of the body. The body has an annular stepped portion to which the cover is retained, at the inner peripheral surface of the upper end portion of the peripheral wall and the cover has an annular fin for elastically contacting the edge of the annular stepped portion.

A third aspect of the invention is to provide a covered airtight container of the first aspect of the invention wherein the same structure as the second aspect of the invention is added to this covered airtight container.

A fourth aspect of the invention is to provide a covered airtight container of the first and third aspect of the inventions wherein the body and cover are square shaped with corners that are slightly curved and the circumferential surfaces of the body and cover being slightly arched.

Since the vertically arranged double annular projections provided at the upper end portion of the peripheral wall of the body are triangular in cross section to form a clearance angle at the lower portion, the edge portion piece of the cover can cover the upper end portion of the peripheral wall of the body, whereby the vertical double annular projections and the annular grooves are combined with one another, which assures the airtight sealing at the portion between the outer surface of the peripheral wall. Furthermore, in the inner surface of the body, the annular fin of the cover elastically contacts the annular stepped portion of the body, which also assures the airtight sealing.

Still Furthermore, when the body and the cover are formed in square shapes, the airtight container does not occupy much space and the end of the edge portion piece of the cover can be cut off along the upper annular grooves of the cover since they are curved along the entire circumference thereof.

When the cover is on the body the cover can not be opened because of the engagement of annular grooves thereof with the annular projections of the body. Therefore, the edge portion piece of the cover needs to be cut off along the upper annular groove by the cutoff device so that the vertically arranged double grooves are disengaged from the vertical double projections when the cover is open.

PREFERRED EMBODIMENT OF THE INVENTION

Figure 1:
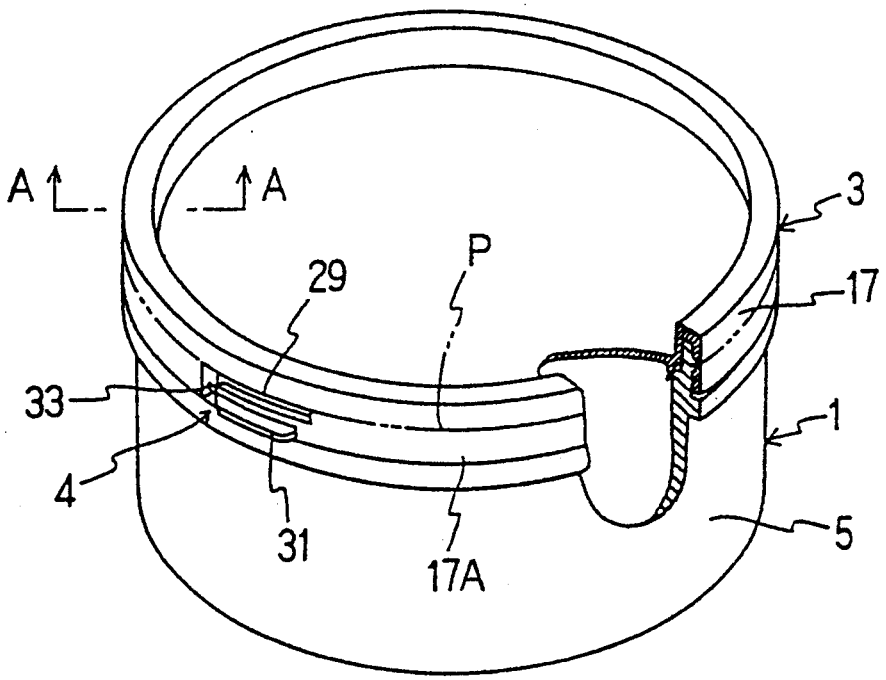
FIG. 1 is a perspective view of a covered airtight container a part of which is cut according to a preferred embodiment of the invention.
Figure 2:
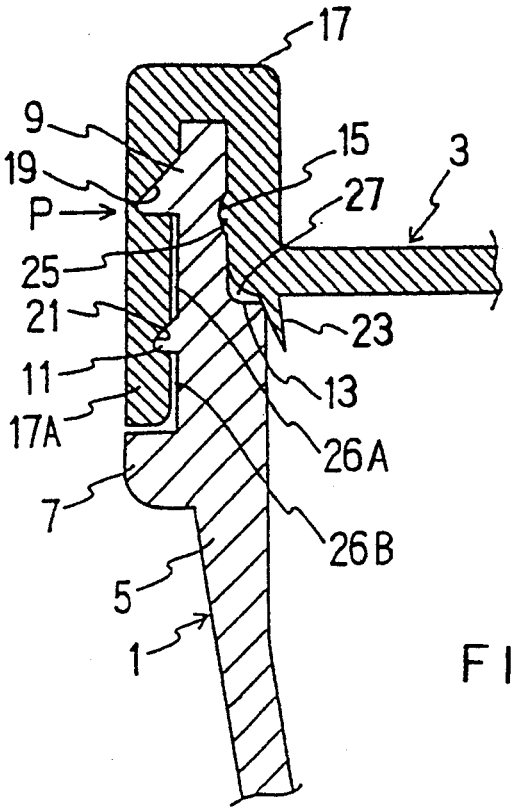
FIG. 2 is an enlarged cross-sectional view taken along the line A—A of FIG. 1.

Preferred Embodiment (FIGS. 1 and, 2):

A covered airtight container according to a preferred embodiment will be described with reference to FIGS. 1 and 2.

A covered airtight container comprises a body 1 formed by injection molding, namely, molded out of hard plastics and a cover 3 formed by the same injection molding, namely, molded out of soft plastics wherein the airtight container is sealed at the inner and outer surfaces of a peripheral wall 5 of the body 1. A cutoff device 4 is provided for releasing the sealed state of the inner side of the air container. The airtight container is circular as a whole but may be square shaped.

There are provided on the outer surface of the peripheral wall 5 of the body 1 a stepped portion 7 in a projected form all the portion close to the upper end thereof and double annular projections 9 and 11 which are positioned above the stepped portion 7 and which are triangular in cross section to form, respectively, a clearance angle at the lower portion thereof wherein the lower annular projection 11 is smaller than the upper annular projection 9. With such an arrangement, the body 1 can be easily covered by the cover 3.

There is provided on the inner surface of the peripheral wall 5, an annular stepped portion 13 which is positioned over the projecting stepped portion 7, wherein the lower portion of the annular stepped portion 13 is perpendicular to the annular stepped portion 13. There is also provided an annular concave portion 15 which is slightly curved in an arc in cross section at the upper portion of the annular stepped portion 13.

The cover 3 has a reverse channel-shaped edge portion piece 17 which is formed by bending the upper end edge thereof at the portion where it is retained by the annular stepped portion 13 of the body 1 upward and reversing it downward so as to cover the upper end portion of the body 1. The reverse channel-shaped edge portion piece 17 of the cover 3 has vertically arranged double annular grooves 19 and 21 for engaging with the annular projections 9 and 11 of the body 1. Since the lower annular groove 21 is shallower than the upper annular groove 21, when the body 1 is covered by the cover 3, the cover 3 easily passes the upper annular groove 21 and is not caught by the upper annular groove 21, which easily assures the covering of the body 1. When the edge portion piece 17 is cut off by the cutoff device 4, the cover is cut off at the portion where the upper annular groove 19 is positioned.

The cover 3 also has an annular fin 23 which is elastically retained by the edge of the annular stepped portion 13 of the body 1. The cover 3 also has an annular convex portion 25 which engages with the annular concave portion 15 of the body 1. With the engagement of the annular convex portion 25 and the annular concave portion 15, the soup is prevented film leaking and the connection of the body 1 and the cover 3 can be stabilized after the lower end portion 17A of the edge portion piece 17 is cut off.

The peripheral wall 5 of the body 1 is connected to the edge portion piece 17 of the cover 3 in an airtight condition where no space is defined between the peripheral wall 5 and the edge portion piece 17. There are defined slight spaces 26A and 26B between the peripheral wall 5 and the edge portion piece 17 at the portion lower than the upper annular projection 9 so as to improve the airtightness between the annular projections 9 and 11 and the annular grooves 19 and 21. There is defined a space 27 between the annular stepped portion 13 of the body 1 and the cover 3 at the portion close to the annular fin 23 of the cover 3 so that the annular fin 23 can perform a line contact with the annular stepped portion 13 so as to obtain contact therebetween under pressure at the entire surface thereof.

If the edge portion piece 17 is pressed into the upper end of the peripheral wall 5 of the body 1 while the body 1 is covered by the cover 3, the vertically arranged double annular projections 9 and 11 are connected to the annular grooves 19 and 21. Hence the cover 3 can not be opened unless the connections therebetween are released. Accordingly, the cutoff device 4 is structured to cut off the edge portion piece 17 along the upper annular groove 19.

The cutoff device 4 is provided with a notched window 29 for assuring the cut off position of the cutoff device 4. The upper edge of the notched window 29 is positioned at P which corresponds to the innermost portion of the upper annular groove 19. A knob 31 is provided on the lower end portion 17A of the edge portion piece 17 and disposed at the lower end portion of the notched window 29 in the manner of projecting from one end of the lower end portion of the notched portion 29 and connecting to the other end thereof at a point connection 33. If the knob 31 is pulled out and cut off at the connecting portion 33, the lower end portion 17A of the edge portion piece 17 can be pulled off at the entire circumference thereof at the position of the upper annular groove 19.

When the edge portion piece 17 is pulled off at the lower end portion 17A, the annular groove 19 and 21 are released from the engagement with the vertically arranged double annular projections 9 and 11 so that the cover 3 can be opened. However, if the body 1 is covered by the cover 3, airtightness between the cover 3 and the peripheral wall 5 can be obtained, which prevents the soup from leaking. Particularly, the prevention function is large because of the contact of the annular fin 23 under pressure with the annular stepped portion 13 of the body 1.

Figure 3:
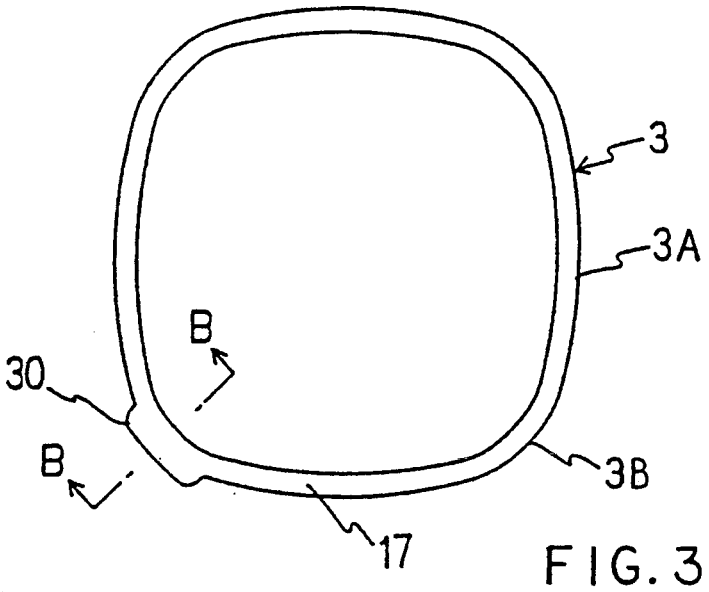
FIG. 3 is a plan view of a covered airtight container according to another embodiment.
Figure 4:
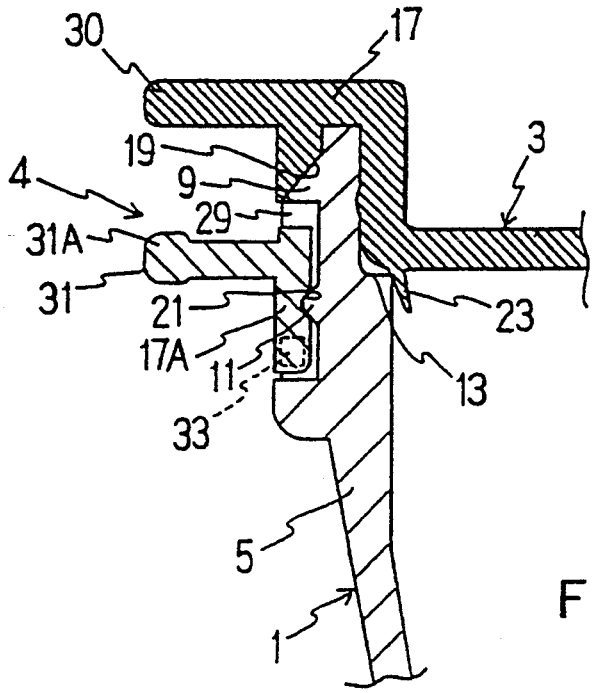
FIG. 4 is an enlarged cross-sectional view taken along the line B—B of FIG. 3.

Modification (FIGS. 3 and 4):

A covered airtight container according to a modification will be described with reference to FIGS. 3 and 4.

The body 1 and the cover 3 of the covered airtight container are both formed square shaped with corner and sides that are slightly curved the at the entire circumferences thereof. That is, each side of the square cover 3 is formed in a curved shape close to the arc of a large circle and each cornered portion 3B is formed in a curved shape close to the arc of a small circle. With such an arrangement, as the characteristics of the square shape, even if the volume of the square container is the same as that of the circular container, there is an advantage that the former does not occupy more surface than the latter during packaging.

Since the upper annular groove 19 is curved at the entire circumference thereof different, from the square airtight container, the lower end portion 17A of the edge portion piece 17 can be smoothly cut off by the cutoff device 4 along the upper annular groove 19. If the container is true square, there is a disadvantage that greater force must be applied to cut off the lower end portion 17A of the edge portion piece 17 which may cause the cornered portions to be pulled off.

When the lower end portion 17A of the edge portion piece 17 of the cover 3 is cut off, the knob 31 is pulled out at the notched portion 29. The knob 31 has an expansion portion 31A in cross section which can be easily pulled out. The lower annular projection 11 is formed like an apex of an isosceles triangle. Furthermore, the cover 3 has a winding piece 30 over the notched portion 29 (seen at the left in FIG. 4) so that the cover 3 can be easily opened. The winding piece 30 prevents the point connection portion 33 from being carelessly cut if the knob 31 contacts other objects during the conveyance thereof.

Materials such as polystyrene (PS), high-impact polystyrene (HiPS), acrylonitrile-styrene resin (AS), acrylonitrile-butadiene-styrene resin (ABS), polycarbonate (PC), etc. can be used as the hard plastics of the body 1. Material such as polyethylene, polypropylene, etc. can be used as the soft plastics of the cover 3.

The covered airtight container of the present invention can effectively prevent soup contained therein from leaking.

Particularly, this leak prevention effect is conspicuous according to the third aspect of the invention since the sealing effect or state can be assured at the inner and outer surfaces of the peripheral wall of the body. Even if the edge portion piece is pulled off after the cover is open so that the vertically arranged double annular projections of the body are disengaged from the vertically arranged annular grooves, the soup is prevented from leaking because of the annular fin of the cover. As a result, the covered airtight container can be used even after the cover is open.

Although the airtight container is formed square shaped according to the fourth aspect of the invention, so as not to occupy much space during the conveyance or the keeping thereof, it is very convenient for handling since the end of the edge portion piece of the cover can be cut off along the upper annular groove.

What is claimed is:

1. A covered airtight container comprising:

a body made of hard plastics and a cover made of soft plastics;

said cover having a reverse channel-shaped edge portion piece formed by bending an upper end edge thereof upward and reversing said upper end edge downward so as to cover an upper end portion of a peripheral wall of said body, said body having vertically arranged upper and lower annular projections at an outer peripheral surface of said upper end portion, each of said annular projections being triangular in cross section to form a clearance angle at a lower portion thereof, and said edge portion piece of said cover having vertically arranged upper and lower annular grooves for engaging with said annular projections of said body and a means for opening said cover extending along said upper annular groove, said upper groove being the uppermost groove on said edge portion.

2. A covered airtight container according to claim 1, wherein said body has an annular stepped portion to which said cover is retained at the inner peripheral surface of the upper end portion of the peripheral wall of said body and said cover has an annular fin elastically contacting and extending a distance below an edge of said annular stepped portion.

3. The covered airtight container of claim 2, wherein an inner gap is defined between said annular stepped portion of said body and the cover at a portion of the cover near said annular fin.

4. A covered airtight container according to claim 1, wherein the body and the cover are both formed generally square shaped with rounded corners.

5. The covered airtight container of claim 1, wherein said body further comprises an annular concave portion at the inner peripheral surface of said upper end portion of said body and said cover further comprises an annular convex portion complimentary in shape to said concave portion of said body which engages said concave portion of said body.

6. The covered airtight container of claim 1, wherein a first gap is defined between said outer peripheral surface of said body and an inside surface of said channel-shaped edge portion piece of said cover between said upper and lower annular grooves, and a second gap is defined between said outer peripheral surface of said body and said inside surface of said channel-shaped edge portion piece of said cover below the lower annular groove.

7. A covered airtight container comprising:

a body made of hard plastics and a cover made of soft plastics;

said cover having a reverse channel-shaped edge portion piece formed by bending an upper end edge thereof upward and reversing the upper end edge downward so as to cover said body, said body having an annular stepped portion to which said cover is retained at an inner peripheral surface of an upper end portion of a peripheral wall of the body and said cover having an annularly projecting fin elastically contacting and extending a distance below an edge of said annular stepped portion, said annularly projecting fin extending downwardly and inwardly of the upwardly directed portion of the edge portion piece.

8. A covered airtight container comprising:

a body made of hard plastics and a cover made of soft plastics;

said cover having a reverse channel-shaped edge portion piece formed by bending an upper edge thereof upward and reversing said upper end edge downward so as to cover an upper end portion of a peripheral wall of said body, said body having vertically arranged upper and lower annular projections at an outer peripheral surface of said upper end portion, each of said annular projections being triangular in cross section to form a clearance angle at a lower portion thereof, and said edge portion piece of said cover having vertically arranged upper and lower annular grooves for engaging with said annular projections of said body, said body further having an annular stepped portion to which said cover is retained at an inner peripheral surface of the upper end portion of the peripheral wall of said body, and said cover further having an annular fin elastically contacting and extending a distance below an edge of said annular stepped portion and a means for opening said cover extending along said upper annular groove, said upper groove being the uppermost groove on said edge portion.

9. A covered airtight container comprising:

a hard plastic body and a soft plastic cover;

said cover having a reverse channel-shaped edge portion piece formed by bending an upper edge thereof upward and reversing said upper edge downward so as to contact an upper end portion of said body at each of an inner peripheral surface, a top surface and an outer peripheral surface of the body, said cover further having vertically arranged upper and lower annular grooves on an inside surface of said channel-shaped edge portion piece that are triangular in cross section, wherein each of said grooves has an upper surface that slopes downwardly and outwardly to a point that meets a lower inwardly extending surface of said groove, said upper groove being the uppermost groove on said edge portion;

said body having vertically arranged double annular projections that are complimentary in shape to said grooves of said cover and located at said outer peripheral surface of said upper end portion of said body for engaging with said annular grooves of said cover; and said cover having a means for removing said cover from said body, said means for removing extending along said upper annular grooves of said cover.

* * * * *